US006758734B2

(12) United States Patent
Braunschweig et al.

(10) Patent No.: US 6,758,734 B2
(45) Date of Patent: Jul. 6, 2004

(54) COATED ABRASIVE ARTICLE

(75) Inventors: Ehrich J. Braunschweig, Woodbury, MN (US); Daidre L. Syverson, Roseville, MN (US); Edward J. Woo, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 136 days.

(21) Appl. No.: 10/100,693

(22) Filed: Mar. 18, 2002

(65) Prior Publication Data

US 2003/0176156 A1 Sep. 18, 2003

(51) Int. Cl.[7] ..... B24D 11/00
(52) U.S. Cl. ..... 451/528; 451/539
(58) Field of Search ..... 451/526, 527, 451/528, 534, 539; 51/295, 298

(56) References Cited

U.S. PATENT DOCUMENTS

| | | | | |
|---|---|---|---|---|
| 4,047,903 | A | | 9/1977 | Hesse et al. |
| 4,250,053 | A | | 2/1981 | Smith |
| 4,256,828 | A | | 3/1981 | Smith |
| 4,314,827 | A | | 2/1982 | Leitheiser et al. |
| 4,518,397 | A | | 5/1985 | Leitheiser et al. |
| 4,623,364 | A | | 11/1986 | Cottringer et al. |
| 4,642,126 | A | | 2/1987 | Zador et al. |
| 4,652,274 | A | | 3/1987 | Boettcher et al. |
| 4,652,275 | A | | 3/1987 | Bloecher et al. |
| 4,744,802 | A | | 5/1988 | Schwabel |
| 4,751,138 | A | | 6/1988 | Tumey et al. |
| 4,770,671 | A | | 9/1988 | Monroe et al. |
| 4,799,939 | A | | 1/1989 | Bloecher et al. |
| 4,881,951 | A | | 11/1989 | Wood et al. |
| 4,904,814 | A | | 2/1990 | Frei et al. |
| 5,011,508 | A | | 4/1991 | Wald et al. |
| 5,059,701 | A | | 10/1991 | Keipert |
| 5,078,753 | A | | 1/1992 | Broberg et al. |
| 5,090,968 | A | | 2/1992 | Pellow |
| 5,108,463 | A | | 4/1992 | Buchanan |
| 5,137,542 | A | | 8/1992 | Buchanan et al. |
| 5,139,978 | A | | 8/1992 | Wood |
| 5,191,101 | A | | 3/1993 | Palazzotto et al. |
| 5,201,916 | A | | 4/1993 | Berg et al. |
| 5,203,884 | A | | 4/1993 | Buchanan et al. |
| 5,227,104 | A | | 7/1993 | Bauer |
| 5,252,694 | A | | 10/1993 | Willett et al. |
| 5,328,716 | A | | 7/1994 | Buchanan |
| 5,366,523 | A | | 11/1994 | Rowenhorst et al. |
| 5,378,251 | A | | 1/1995 | Culler et al. |
| 5,417,726 | A | | 5/1995 | Stout et al. |
| 5,429,647 | A | | 7/1995 | Larmie |
| 5,498,269 | A | | 3/1996 | Larmie |
| 5,505,747 | A | | 4/1996 | Chesley et al. |
| 5,549,962 | A | | 8/1996 | Holmes et al. |
| 5,551,963 | A | | 9/1996 | Larmie |
| 5,552,225 | A | | 9/1996 | Ho |
| 5,556,437 | A | | 9/1996 | Lee et al. |
| 5,560,753 | A | | 10/1996 | Schnabel et al. |
| 5,565,011 | A | | 10/1996 | Follett et al. |
| 5,573,619 | A | | 11/1996 | Benedict et al. |
| 5,582,625 | A | | 12/1996 | Wright et al. |
| 5,672,186 | A | | 9/1997 | Chesley et al. |
| 5,700,302 | A | | 12/1997 | Stoetzel et al. |
| 5,766,277 | A | | 6/1998 | DeVoe et al. |
| 5,863,847 | A | | 1/1999 | DeVoe et al. |
| 5,922,784 | A | | 7/1999 | DeVoe et al. |
| 5,942,015 | A | | 8/1999 | Culler et al. |
| 6,077,601 | A | * | 6/2000 | DeVoe et al. ..... 428/323 |
| 6,258,138 | B1 | | 7/2001 | DeVoe et al. |
| 2001/0011108 | A1 | | 8/2001 | Thurber et al. |

FOREIGN PATENT DOCUMENTS

| | | |
|---|---|---|
| EP | 0 284 064 A2 | 9/1988 |
| FR | 2 385 494 | 10/1978 |
| JP | 4-261421 | 9/1992 |
| WO | WO 96/38263 | 12/1996 |
| WO | WO 97/31079 | 8/1997 |
| WO | WO 98/10896 | 3/1998 |
| WO | WO 98/32566 | 7/1998 |
| WO | WO 00/38886 | 7/2000 |

OTHER PUBLICATIONS

U.S. patent application Ser. No. 09/812,174, filed Mar. 20, 2001, Abrasive Articles Having a Polymeric Material (Attorney Case No. 55577–USA–8A.002).

* cited by examiner

*Primary Examiner*—Dung Van Nguyen
(74) *Attorney, Agent, or Firm*—Bradford B. Wright

(57) ABSTRACT

Coated abrasive articles comprise a backing and an abrasive layer, wherein at the abrasive layer comprises a reaction product of components comprising polyfunctional acrylate, alicyclic polyepoxide, and aromatic polyepoxide having an average epoxy functionality of at least 2.5.

45 Claims, 2 Drawing Sheets

COATED ABRASIVE ARTICLE

TECHNICAL FIELD

The present invention relates to coated abrasive articles and to methods of making and using the same.

BACKGROUND OF THE INVENTION

In general, coated abrasive articles have abrasive particles secured to a backing. More typically, coated abrasive articles comprise a backing having two major opposed surfaces and an abrasive layer secured to a major surface. The abrasive layer is typically comprised of abrasive particles and a binder, wherein the binder serves to secure the abrasive particles to the backing.

One common type of coated abrasive article has an abrasive layer which comprises a make layer, a size layer, and abrasive particles. In making such a coated abrasive article, a make layer comprising a first binder precursor is applied to a major surface of the backing. Abrasive particles are then at least partially embedded into the make layer (e.g., by electrostatic coating), and the first binder precursor is cured (i.e., crosslinked) to secure the particles to the make layer. A size layer comprising a second binder precursor is then applied over the make layer and abrasive particles, followed by curing of the binder precursors.

Another common type of coated abrasive article comprises an abrasive layer secured to a major surface of a backing, wherein the abrasive layer is provided by applying a slurry comprised of binder precursor and abrasive particles onto a major surface of a backing, and then curing the binder precursor.

Optionally, coated abrasive articles may further comprise, for example, a backsize layer (i.e., a coating on the major surface of the backing opposite the major surface having the abrasive layer), a presize layer (i.e., a coating between the abrasive layer and the major surface to which the abrasive layer is secured), and/or a saturant which coats both major surfaces of the backing. In another aspect, coated abrasive articles may further comprise a supersize layer covering the abrasive layer. The supersize layer typically includes grinding aids and/or anti-loading materials.

Typically, binder precursors employed in make, size, and/or slurry layers of the abrasive layer are cured at an elevated temperature (e.g., in the range of 100 to 170° C.) for a length of time (e.g., in the range of from 15 minutes to 8 hours). Under such conditions, many thermally-sensitive materials that would otherwise be useful as backings in abrasive articles may soften, warp, decompose, etc. It would be desirable to have useful make, size, and/or slurry layer formulations that can be cured at relatively low temperatures, thereby increasing the number of materials that are suitable for use as backings.

Further, after curing the abrasive layer at the elevated temperature, the backing and the abrasive layer typically shrink on cooling. The backing and abrasive layer usually have different coefficients of thermal expansion. As a result, differential shrinkage and/or expansion of the backing and abrasive layer normally occurs. For relatively flexible backings, this differential shrinkage usually causes the finished article to curl. The amount of curl depends on, for example, among other factors, the magnitude of the difference between the various coefficients of thermal expansion of the backing and the abrasive layer. In the case of polypropylene backings, this problem may be especially noticeable. Generally, this effect is proportional to difference between the curing temperature and ambient temperature. Excessive curl may cause problems in handling and/or using the coated abrasive article. By way of illustration, FIG. 1 is a photograph of a prior art coated abrasive article (prepared according to Comparative Example 1) having excessive curl, which was cured at elevated temperature. Thus, it would be desirable to provide coated abrasive articles that do not have excessive curl, and methods for making such articles.

In cases in which curling of the coated abrasive article does not occur, such as in the case of a rigid backing, differential shrinkage may result in an accumulation of stress at, for example, the interface between the backing and the make layer (and/or between the make and size layers). Such accumulated stress at the interface may lead, for example, to less than desirable adhesion at the interface. It would be desirable to reduce the level of such interfacial accumulated stress.

Simply reducing the temperature used to cure binder precursors in make, size, and/or slurry layers may result in a reduced degree of cure, which may not be sufficient to provide the desired, or even useful, durability and/or cut performance of the coated abrasive article.

It would be desirable to have materials and processes for making coated abrasive articles that have low levels of interfacial accumulated stress and/or reduced curl, yet that achieve a degree of cure sufficient to provide a coated abrasive article having at least good abrasive performance.

SUMMARY OF THE PRESENT INVENTION

The present invention provides a solution to problems of interfacial stress and/or curl in coated abrasive articles by utilizing a binder precursor comprising a mixture of acrylate and epoxy functional materials.

In one aspect, the present invention provides a coated abrasive article comprising:

- a backing having a major surface; and
- an abrasive layer secured to at least a portion of the major surface, the abrasive layer comprising a binder and abrasive particles, wherein the binder comprises a reaction product of components comprising polyfunctional acrylate, alicyclic polyepoxide, and aromatic polyepoxide having an average epoxy functionality of at least 2.5.

In another aspect, the present invention provides a coated abrasive article comprising:

- a backing having a major surface;
- an abrasive layer secured to at least a portion of the major surface, the abrasive layer comprising:
  - a make layer comprising a first binder;
  - abrasive particles at least partially embedded in the make layer; and
  - a size layer comprising a second binder, at least partially covering the abrasive layer, wherein at least one of the first or second binders comprise a reaction product of components comprising polyfunctional acrylate, alicyclic polyepoxide, and aromatic polyepoxide having an average epoxy functionality of at least 2.5.

In another aspect, the present invention provides a coated abrasive article comprising:

- a backing having a major surface;
- an abrasive layer secured to at least a portion of the major surface, the abrasive layer comprising a slurry layer comprising a binder and abrasive particles, wherein the binder comprises a reaction product of components comprising polyfunctional acrylate, alicyclic polyepoxide, and aromatic polyepoxide having an epoxy functionality of at least 2.5.

In another aspect, the present invention provides a method for making a coated abrasive article comprising:

providing a backing having a major surface;

applying a make layer comprising a first binder precursor onto at least a portion of the major surface of the backing;

at least partially embedding a plurality of abrasive particles into the make layer;

curing the first binder precursor;

applying a size layer comprising a second binder precursor onto at least a portion of the make layer and plurality of abrasive particles; and curing the second binder precursor to provide a coated abrasive article, wherein at least one of the first or second binder precursors comprises polyfunctional acrylate, alicyclic polyepoxide, and aromatic polyepoxide having an average epoxy functionality of at least 2.5, and wherein at least one of the first or second binder precursors is cured by exposure to actinic radiation.

In another aspect, the present invention provides a method for making a coated abrasive article comprising:

providing a backing having a major surface;

applying a slurry comprising a binder precursor and abrasive particles onto at least a portion of the major surface of the backing, the binder precursor comprising at least one polyfunctional acrylate, at least one alicyclic polyepoxide, and at least one aromatic polyepoxide having an epoxy functionality of at least 2.5; and curing the binder precursor by exposure to actinic radiation to provide a coated abrasive article.

In another aspect, the invention provides a method of abrading a workpiece comprising:

providing a coated abrasive article comprising:

a backing having a major surface;

an abrasive layer secured to at least a portion of the major surface, the abrasive layer comprising a make layer comprising a first binder and abrasive particles; and a size layer comprising a second binder at least partially covering the abrasive layer, wherein at least one of the first or second binders comprise a reaction product of components comprising at least one polyfunctional acrylate, at least one alicyclic polyepoxide, and at least one aromatic polyepoxide having an average epoxy functionality of at least 2.5;

frictionally contacting at least a portion of the abrasive layer with at least a portion of the surface of the workpiece; and moving at least one of the coated abrasive article or the workpiece relative to the other to abrade at least a portion of the surface.

In another aspect, the invention provides a method of abrading a workpiece comprising:

providing a coated abrasive article comprising:

a backing having a major surface;

an abrasive layer secured to at least a portion of the major surface, the abrasive layer comprising a slurry layer comprising a binder and abrasive particles, wherein the binder comprises a reaction product of components comprising at least one polyfunctional acrylate, at least one alicyclic polyepoxide, and at least one aromatic polyepoxide having an average epoxy functionality of at least 2.5;

frictionally contacting at least a portion of the abrasive layer with at least a portion of the surface of the workpiece; and moving at least one of the coated abrasive article or the workpiece relative to the other to abrade at least a portion of the surface.

Coated abrasive articles prepared according to the present invention may be cured at temperatures below about 100° C., resulting in a relatively low degree of curl, while achieving at least good levels of abrading performance.

As used herein:

"acrylate" includes both acrylate and methacrylate;

"acrylate functionality" refers to the number of acryloxy groups per molecule;

"acryloxy" includes both acryloxy and methacryloxy;

"actinic radiation" means particulate and non-particulate radiation and includes electron beam radiation as well as electromagnetic radiation having at least one wavelength in the range of from about 200 to about 700 nanometers;

"alicyclic" means aliphatic and containing at least one saturated cyclic ring;

"alicyclic polyepoxide" refers to an alicyclic material having an average epoxy functionality of at least 2;

"aromatic" means containing at least one aromatic ring;

"average acrylate functionality" refers to the average number of acryloxy groups per molecule; it is determined for a specified material by dividing the total number of acryloxy groups by the total number of molecules having acryloxy groups;

"average epoxy functionality" refers to the average number of epoxy groups per molecule; it is determined for a specified material by dividing the total number of epoxy groups by the total number of molecules having epoxy groups;

"bireactive compounds" are those which contain at least one ethylenically-unsaturated group and at least one 1,2-epoxide group;

"crosslinked" means having polymeric sections that are interconnected through chemical bonds (i.e., interchain links) to form a three-dimensional molecular network;

"epoxy functionality" refers to the number of epoxy groups per molecule;

"epoxy resin" refers to a material containing molecules having at least one epoxy group;

"epoxy group" refers to an oxiranyl group;

"oligomer" refers to a polymer molecule having 2 to 10 repeating units (e.g., dimer, trimer, tetramer, and so forth) having an inherent capability of forming chemical bonds with the same or other oligomers in such manner that longer polymeric chains can be formed therefrom;

"photoinitiator" refers to a substance, which, if exposed to electromagnetic radiation having at least one wavelength in the range of from about 200 to about 700 nanometers, forms an initiator for free-radical polymerization;

"photocatalyst" refers to a substance, which, if exposed to electromagnetic radiation having at least one wavelength in the range of from about 200 to about 700 nanometers, forms a catalyst for cationic polymerization; and "polyfunctional acrylate" refers to a material having an average acrylate functionality of at least 2.

DETAILED DESCRIPTION

Figure 2:
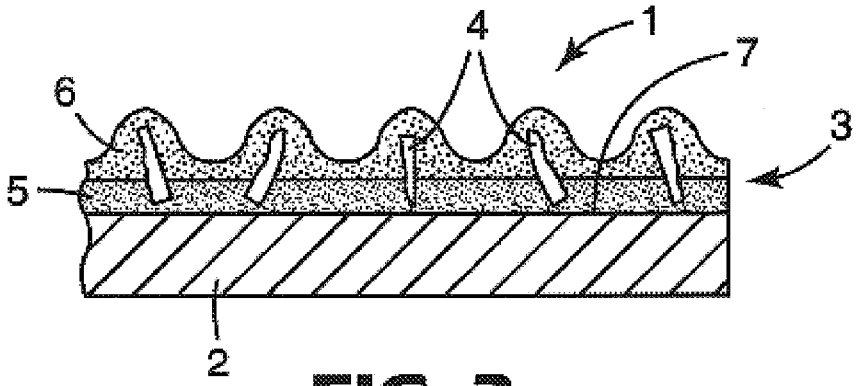
FIG. 2 is a cross-sectional view of a section of an exemplary coated abrasive article according to the present invention.

One embodiment of a coated abrasive article according to the present invention is illustrated in FIG. 2. Referring to this figure, coated abrasive article 1 has backing 2 and abrasive layer 3. Abrasive layer 3 includes abrasive particles 4 secured to major surface 7 of backing 2 by make layer 5 and size layer 6.

Suitable backings for coated abrasive articles according to the present invention include those known in the art for making coated abrasive articles, including conventional sealed coated abrasive backings and porous non-sealed backings. Typically, the backing has two opposed major surfaces. The thickness of the backing generally ranges from about 0.02 to about 5 millimeters, desirably from about 0.05 to about 2.5 millimeters, and more desirably from about 0.1 to about 0.4 millimeter, although thicknesses outside of these ranges may also be useful.

The backing may be flexible or rigid. Desirably the backing is flexible. The backing may be made of any number of various materials including those conventionally used as backings in the manufacture of coated abrasives. Examples include paper, cloth, film, polymeric foam, vulcanized fiber, woven and nonwoven materials, combinations of two or more of these materials, as well as treated versions thereof. The backing may also be a laminate of two materials (e.g., paper/film, cloth/paper, film/cloth).

Exemplary flexible backings include polymeric film (including primed films) such as polyolefin film (e.g., polypropylene including biaxially oriented polypropylene, polyester film, polyamide film, cellulose ester film), metal foil, mesh, foam (e.g., natural sponge material or polyurethane foam), cloth (e.g., cloth made from fibers or yams comprising polyester, nylon, silk, cotton, and/or rayon), paper, vulcanized paper, vulcanized fiber, nonwoven materials, combinations thereof, and treated versions thereof Cloth backings may be woven or stitch bonded. Desirably, the backing comprises polypropylene film.

The choice of backing material may depend, for example, on the intended application of the coated abrasive article. The strength of the backing should be sufficient to resist tearing or other damage in use. The thickness and smoothness of the backing should also be suitable to provide the desired thickness and smoothness of the coated abrasive article, wherein such characteristics of the coated abrasive article may vary depending, for example, on the intended application or use of the coated abrasive article.

The backing may, optionally, have at least one of a saturant, a presize layer and/or a backsize layer. The purpose of these materials is typically to seal the backing and/or to protect yarn or fibers in the backing. If the backing is a cloth material, at least one of these materials is typically used. The addition of the presize layer or backsize layer may additionally result in a "smoother" surface on either the front and/or the back side of the backing. Other optional layers known in the art may also be used (e.g., tie layer; see, e.g., U.S. Pat. No. 5,700,302 (Stoetzel et al.), the disclosure of which is incorporated by reference).

An antistatic material may be included in any of these cloth treatment materials. The addition of an antistatic material can reduce the tendency of the coated abrasive article to accumulate static electricity when sanding wood or wood-like materials. Additional details regarding antistatic backings and backing treatments can be found in, for example, U.S. Pat. No. 5,108,463 (Buchanan et al.); U.S. Pat. No. 5,137,542 (Buchanan et al.); U.S. Pat. No. 5,328,716 (Buchanan); and U.S. Pat. No. 5,560,753 (Buchanan et al.), the disclosures of which are incorporated herein by reference.

The backing may be a fibrous reinforced thermoplastic such as described, for example, as described, for example, in U.S. Pat. No. 5,417,726 (Stout et al.), or an endless spliceless belt, for example, as described, for example, in U.S. Pat. No. 5,573,619 (Benedict et al.), the disclosures of which are incorporated herein by reference. Likewise, the backing may be a polymeric substrate having hooking stems projecting therefrom such as that described, for example, in U.S. Pat. No. 5,505,747 (Chesley et al.), the disclosure of which is incorporated herein by reference. Similarly, the backing may be a loop fabric such as that described, for example, in U.S. Pat. No. 5,565,011 (Follett et al.), the disclosure of which is incorporated herein by reference.

In some instances, it may be desirable to incorporate a pressure-sensitive adhesive onto the back side of the coated abrasive article such that the resulting coated abrasive article can be secured to a back up pad. Exemplary pressure-sensitive adhesives include latex crepe, rosin, acrylic polymers and copolymers including polyacrylate esters (e.g., poly(butyl acrylate)), vinyl ethers (e.g., poly(vinyl n-butyl ether)), alkyd adhesives, rubber adhesives (e.g., natural rubber, synthetic rubber, chlorinated rubber), and mixtures thereof.

Exemplary rigid backings include metal plates, ceramic plates, and the like. Another example of a suitable rigid backing is described, for example, in U.S. Pat. No. 5,417,726 (Stout et al.), the disclosure of which is incorporated herein by reference.

To promote adhesion of the make layer, slurry layer, and/or optional backsize layer, it may be necessary to modify the surface to which these layers are applied. Exemplary surface modifications include corona discharge, ultraviolet light exposure, electron beam exposure, flame discharge, and/or scuffing.

Advantageously, since the abrasive layer formulations utilized in the present invention cure at low temperatures, the backing may be thermally-sensitive (i.e., it may be of a material or construction that decomposes and/or deforms at elevated temperatures (e.g., temperatures of greater than about 100° C.)).

In some embodiments of the present invention, the abrasive layer comprises make and size layers. The make or the size layers may be a make or size layer known in the abrasive art, provided that at least one of the make or size layer, comprises reaction product of binder precursor comprising polyfunctional acrylate, alicyclic polyepoxide, and aromatic polyepoxide having an average epoxy functionality of at least 2.5. Desirably, both the make and size layers comprise reaction product of binder precursor comprising polyfunctional acrylate, alicyclic polyepoxide, and aromatic polyepoxide having an average epoxy functionality of at least 2.5. The binder precursor is cured to form a binder using the methods described hereinbelow.

In some embodiments, the binder precursor comprising the make layer is desirably a hot melt adhesive. In such embodiments, the binder precursor is typically applied to the backing as a molten material. Abrasive particles are at least partially embedded into the molten binder precursor which is then cured thereby fixing the abrasive particles to the make layer. A size layer, for example, a size layer comprising reaction product of binder precursor comprising polyfunctional acrylate, alicyclic polyepoxide, and aromatic polyepoxide having an average epoxy functionality of at least 2.5, is then applied over the make layer and abrasive particles and cured.

Optionally, the binder precursor may further include catalysts and/or curing agents to initiate and/or accelerate the curing process, as well as in addition or alternatively, other known additives such as fillers, thickeners, tougheners, grinding aids, pigments, fibers, tackifiers, lubricants, wetting agents, surfactants, antifoaming agents, dyes, coupling agents, plasticizers, suspending agents, and the like.

Exemplary known make and size layers typically comprise a binder resin such as a glue or a phenolic resin, aminoplast resin, urea-formaldehyde resin, melamine-formaldehyde resin, urethane resin, (e.g., an aminoplast resin having pendant $\alpha,\beta$-unsaturated groups, acrylated urethane, acrylated epoxy, acrylated isocyanurate), acrylic resin, epoxy resin (including bis-maleimide and fluorene-modified epoxy resins), isocyanurate resin, as well as mixtures thereof.

The basis weight of the make layer utilized may depend, for example, on the intended use(s), type(s) of abrasive particles, and nature of the coated abrasive article being prepared, but generally will be in the range of from about 1 to about 30 grams per square meter (i.e., $g/m^2$), desirably from about 10 to about 25 $g/m^2$, and more desirably from about 15 to about 25 $g/m^2$. The make layer may be applied by any known coating method for applying a make layer to a backing, including roll coating, extrusion die coating, curtain coating, knife coating, gravure coating, spray coating, and the like.

The basis weight of the size layer will also necessarily vary depending on the intended use(s), type(s) of abrasive particles, and nature of the coated abrasive article being prepared, but generally will be in the range of from about 1 to about 400 $g/m^2$, desirably from about 1 to about 300 $g/m^2$, and more desirably from about 5 to about 300 $g/m^2$. The size layer may be applied by any known coating method for applying a size layer to a backing, including roll coating, extrusion die coating, curtain coating, spray coating, and the like.

In some embodiments of coated abrasive articles according to the present invention, the abrasive layer comprises a slurry layer comprising abrasive particles and binder that is the reaction product of components comprising polyfunctional acrylate, alicyclic polyepoxide, and aromatic polyepoxide having an average epoxy functionality of at least 2.5. Slurry coating techniques are well known in the abrasive art, and include those described, for example, in U.S. Pat. No. 5,378,251 (Culler et al.) and U.S. Pat. No. 5,942,015 (Culler et al.), the disclosures of which are incorporated herein by reference.

Polyfunctional acrylate that may be utilized in practice of the present invention includes acrylate monomers, acrylate oligomers, acrylated polymers, and mixtures thereof.

The amount of polyfunctional acrylate present in binder precursors for uncured make layers, size layers, and/or slurry layers utilized in the present invention typically ranges from about 5 to about 90 percent by weight, desirably from about 20 to about 85 percent by weight, and even more desirably from about 60 to about 80 percent by weight, based on the total combined weight of polyfunctional acrylate, alicyclic polyepoxide, and aromatic polyepoxide having an average epoxy functionality of at least 2.5, although amounts outside these ranges may also be useful.

A wide variety of acrylate monomers, acrylate oligomers, and acrylated polymers are readily commercially available, for example, from such vendors as Sartomer Co., Exton, Pa., and UCB Chemicals Corp., Smyrna, Ga. Exemplary acrylate monomers include ethylene glycol diacrylate and methacrylate, hexanediol diacrylate, triethylene glycol diacrylate and methacrylate, trimethylolpropane triacrylate, glycerol triacrylate, pentaerythritol triacrylate and methacrylate, ethoxylated trimethylolpropane triacrylate and trimethacrylate, neopentyl glycol diacrylate and dimethacrylate, pentaerythritol tetraacrylate and tetramethacrylate, dipentaerythritol pentaacrylate, sorbitol triacrylate, sorbitol hexaacrylate, Bisphenol A diacrylate, ethoxylated Bisphenol A diacrylate, and mixtures thereof.

Example of useful acrylate monomers include trimethylolpropane triacrylate, available, for example, from Sartomer Co. under the trade designation "SR 351"; ethoxylated trimethylolpropane triacrylate, available, for example, from Sartomer Co. under the trade designation "SR 454"; pentaerythritol tetraacrylate, available, for example, from Sartomer Co. under the trade designation "SR 295"; and neopentyl glycol diacrylate, available, for example, from Sartomer Co. under the trade designation "SR 247".

Desirably, polyfunctional acrylate comprises an acrylate oligomer. Exemplary acrylate oligomers include acrylated epoxy oligomers (e.g., Bisphenol-A based epoxy acrylate oligomers), aliphatic urethane acrylate oligomers, and aromatic urethane acrylate oligomers. Additional useful polyfunctional acrylate oligomers include polyether oligomers such as a polyethylene glycol 200 diacrylate, available, for example, from Sartomer Co. under the trade designation "SR 259" and a polyethylene glycol 400 diacrylate, available, for example, from Sartomer Co. under the trade designation "SR 344"; and acrylated epoxies including those available, for example, under the trade designations "EBECRYL 3500", "EBECRYL 3600", and "EBECRYL 3700", from UCB Chemicals Corp. Desirably the acrylate oligomer is an acrylated epoxy oligomer.

Polyfunctional acrylate may comprise a blend of two or more polymerizable acrylates. If used, such blends typically comprise a plurality of various polyfunctional acrylate monomers, acrylate oligomers, and/or acrylated polymers; in some instances, such as to adjust viscosity of the binder precursor or physical properties of the cured binder, it may be desirable to include one or more monofunctional acrylate monomers in the polyfunctional acrylate.

In any event, polyfunctional acrylate, whether present as a blend of polymerizable acrylate materials or as a single component, has an average acryloxy group functionality of at least 2, desirably at least 2.5, more desirably at least 3.

Alicyclic polyepoxide that may be utilized in practice of the present invention includes monomeric alicyclic polyepoxides, oligomeric alicyclic polyepoxides, polymeric alicyclic polyepoxides, and mixtures thereof.

The amount of alicyclic polyepoxide present in binder precursors for make layers, size layers, and/or slurry layers utilized in the present invention typically ranges from about 1 to about 27 percent by weight, desirably 6 to about 13 percent by weight, more desirably 8 to about 12 percent by weight, based on the total combined weight of polyfunctional acrylate, alicyclic polyepoxide, and aromatic polyepoxide having an average epoxy functionality of at least 2.5, although amounts outside these ranges may also be useful.

A wide variety of alicyclic polyepoxide monomers, polyepoxide oligomers, and polyepoxide polymers that are commercially available may be used in practice of the present invention. Exemplary alicyclic polyepoxides monomers useful in practice of the present invention include epoxycyclohexanecarboxylates (e.g., 3,4-epoxycyclohexylmethyl 3,4-epoxycyclohexanecarboxylate (available, for example, under the trade designation "ERL-4221" from Dow Chemical Co., Midland, Mich.), 3,4-epoxy-2-methylcyclohexylmethyl 3,4-epoxy-2-methylcyclohexanecarboxylate, bis(3,4-epoxy-6-methylcyclohexylmethyl) adipate, 3,4-epoxy-6-methylcyclohexylmethyl 3,4-epoxy-6-methylcyclohexanecarboxylate (available, for example, under the trade designation "ERL-4201" from Dow Chemical Co.)); vinylcyclohexene dioxide (available, for example, under the trade designation "ERL-4206" from Dow Chemical Co.); bis(2,3-epoxycyclopentyl) ether (available, for example, under the trade designation "ERL-0400" from Dow Chemical Co.), bis(3,4-epoxy-6-methylcyclohexylmethyl) adipate (available, for example, under the trade designation "ERL-4289" from Dow Chemical Co.), dipenteric dioxide (available, for example, under the trade designation "ERL-4269" from Dow Chemical Co.), 2-(3,4-epoxycyclohexyl-5,1'-spiro-3',4'-epoxycyclohexane-1,3-dioxane, and 2,2-bis(3,4-epoxycyclohexyl)propane. 3,4-Epoxycyclohexylmethyl 3,4-epoxycyclohexanecarboxylate is an especially desirable alicyclic polyepoxide resin having an average functionality of at least 2.

Aromatic polyepoxide that may be utilized in practice of the present invention includes monomeric aromatic polyepoxides, oligomeric aromatic polyepoxides, polymeric aromatic polyepoxides, and mixtures thereof.

Useful aromatic polyepoxides have an average epoxy functionality of at least 2.5, and include monomeric aromatic polyepoxides, oligomeric aromatic polyepoxides, polymeric aromatic polyepoxides, and mixtures thereof.

The amount of aromatic polyepoxide having an average epoxy functionality of at least 2.5 present in binder precursors for abrasive layers and size layers utilized in make layers, size layers, and/or slurry layers utilized in the present invention typically ranges from about 6 to about 75 percent by weight, desirably 14 to about 54 percent by weight, more desirably 17 to about 23 percent by weight, wherein the combined weight of the at least one polyfunctional acrylate, the at least one alicyclic polyepoxide, and the at least one aromatic polyepoxide having an average epoxy functionality of at least 2.5 totals 100 percent by weight, although amounts outside these ranges may also be useful. To promote rapid complete curing, the average epoxy functionality of the aromatic polyepoxide is desirably at least 3.5. Exemplary aromatic polyepoxides that can be used in the present invention include the polyglycidyl ethers of polyhydric phenols such as: Bisphenol A-type resins and their derivatives, including such epoxy resins having the trade designation "EPON" (e.g., "EPON 828" and "EPON 1001F"), available, for example, from Resolution Performance Products, Houston, Tex.; epoxy cresol-novolac resins; Bisphenol-F resins and their derivatives; epoxy phenol-novolac resins; and glycidyl esters of aromatic carboxylic acids (e.g., phthalic acid diglycidyl ester, isophthalic acid diglycidyl ester, trimellitic acid triglycidyl ester, and pyromellitic acid tetraglycidyl ester), and mixtures thereof.

Exemplary commercially available aromatic polyepoxides include those having the trade designation "ARALDITE" (e.g., "ARALDITE MY-720", "ARALDITE 721", "ARALDITE 722", "ARALDITE 0510", "ARALDITE 0500", "ARALDITE PY-306", and "ARALDITE 307"), available, for example, from Ciba Specialty Chemicals, Tarrytown, N.Y.; aromatic polyepoxides having the trade designation "EPON" (e.g., "EPON DPL-862" and "EPON HPT-1079"), available, for example, from Resolution Performance Products; and aromatic polyepoxides having the trade designations "DER", "DEN" (e.g., "DEN 438", and DEN 439"), and "QUATREX", available, for example, from Dow Chemical Co.

Desirably, the aromatic polyepoxide includes a polyglycidyl ether of a polyhydric phenol, more desirably a diglycidyl ether of Bisphenol A.

Abrasive particles suitable for use in abrasive layers utilized in practice of the present invention include any abrasive particles known in the abrasive art. Exemplary useful abrasive particles include fused aluminum oxide based materials such as aluminum oxide, ceramic aluminum oxide (which may include one or more metal oxide modifiers and/or seeding or nucleating agents), and heat-treated aluminum oxide, silicon carbide, co-fused alumina-zirconia, diamond, ceria, titanium diboride, cubic boron nitride, boron carbide, garnet, flint, emery, sol-gel derived abrasive particles, and blends thereof. Desirably, the abrasive particles comprise fused aluminum oxide, heat-treated aluminum oxide, ceramic aluminum oxide, silicon carbide, alumina zirconia, garnet, diamond, cubic boron nitride, sol-gel derived abrasive particles, or mixtures thereof. Examples of sol-gel abrasive particles include those described U.S. Pat. No. 4,314,827 (Leitheiser et al.); U.S. Pat. No. 4,518,397 (Leitheiser et al.); U.S. Pat. No. 4,623,364 (Cottringer et al.); U.S. Pat. No. 4,744,802 (Schwabel); U.S. Pat. No. 4,770,671 (Monroe et al.); U.S. Pat. No. 4,881,951 (Wood et al.); U.S. Pat. No. 5,011,508 (Wald et al.); U.S. Pat. No. 5,090,968 (Pellow); U.S. Pat. No. 5,139,978 (Wood); U.S. Pat. No. 5,201,916 (Berg et al.); U.S. Pat. No. 5,227,104 (Bauer); U.S. Pat. No. 5,366,523 (Rowenhorst et al.); U.S. Pat. No. 5,429,647 (Laramie); U.S. Pat. No. 5, 498,269 (Larmie); and U.S. Pat. No. 5,551,963 (Larmie), the disclosures of which are incorporated herein by reference. The abrasive particles may be in the form of, for example, individual particles, agglomerates, abrasive composite particles, and mixtures thereof. Exemplary agglomerates are described, for example, in U.S. Pat. No. 4,652,275 (Bloecher et al.) and U.S. Pat. No. 4,799,939 (Bloecher et al.), the disclosures of which are incorporated herein by reference. It is also within the scope of the present invention to use diluent erodible agglomerate grains as described, for example, in U.S. Pat. No. 5,078,753 (Broberg et al.), the disclosure of which is incorporated herein by reference.

Abrasive composite particles comprise abrasive grains in a binder. Exemplary abrasive composite particles are described, for example, in U.S. Pat. No. 5,549,962 (Holmes et al.), the disclosure of which is incorporated herein by reference.

The abrasive particles typically have an average diameter of from about 0.1 to about 2000 micrometers, more desirably from about 1 to about 1300 micrometers. Coating weights for the abrasive particles may depend, for example, on the binder precursor used, the process for applying the abrasive particles, and the size of the abrasive particles, but typically range from about 5 to about 1,350 g/m$^2$.

The binder precursor may further comprise an optional bireactive polymerizable component, for example, a compound having at least one free-radically polymerizable group, and at least one cationically polymerizable group. Bireactive compounds can be made, for example, by introducing at least one ethylenically-unsaturated group into a compound that already contains one or more epoxy groups, or, conversely, by introducing at least one epoxy group into a compound that already contains one or more ethylenically-unsaturated group.

Exemplary bireactive polymerizable compounds include those contained in the reaction products of 0.4 to 0.6 weight equivalent of an acrylic acid and one mole of diglycidyl ether of Bisphenol A, polyglycidyl ether of phenol-formaldehyde novolac, polyglycidyl ether of cresol-formaldehyde novolac, diglycidyl terephthalate, triglycidyl ester of trimellitic acid, dicyclopentadiene dioxide, vinylcyclohexene dioxide, bis(2,3-epoxycyclopentyl)ether, 3,4-epoxycyclohexylmethyl 3,4-epoxycyclohexanecarboxylate, and bis(3,4-epoxy-6-methylcyclohexyl)methyl adipate.

If used, optional bireactive materials are desirably selected such that they do not significantly inhibit the cure of cationically polymerizable resin. Exemplary groups that may interfere with such cure include, primary, secondary and tertiary amines, amides, imides, and the like.

Optional curatives useful in practice of the present invention include those that are photosensitive or thermally-sensitive, and desirably comprise at least one free-radical polymerization initiator and at least one cationic polymerization catalyst, which may be the same or different. In order to minimize heating during cure while preserving pot-life of the binder precursor, the binder precursors employed in make, size, and/or slurry layer utilized in the present invention are desirably photosensitive, and desirably comprise a photoinitiator and/or a photocatalyst. More desirably, the binder precursors employed in make, size, and/or slurry layers utilized in the present invention comprise a photoinitiator and a photocatalyst.

"Photocatalysts" as defined herein are materials that form active species that, if exposed to actinic radiation, are capable of at least partially polymerizing polyepoxides employed in practice of the present invention. Optionally, the binder precursor may comprise at least one photocatalyst (e.g., an onium salt and/or cationic organometallic salt).

Desirably, onium salt photocatalysts comprise iodonium complex salts and/or sulfonium complex salts. Useful aromatic onium complex salts are further described, for example, in U.S. Pat. No. 4,256,828 (Smith), the disclosure of which is incorporated herein by reference. Exemplary aromatic iodonium complex salts include diaryliodonium hexafluorophosphate or a diaryliodonium hexafluoroantimonate. Exemplary aromatic sulfonium complex salts include as triphenylsulfonium hexafluoroantimonate and p-phenyl(thiophenyl)diphenylsulfonium hexafluoroantimonate.

Aromatic onium salts, useful in practice of the present invention, are typically photosensitive only in the ultraviolet region of the spectrum. However, they can be sensitized to the near ultraviolet and the visible range of the spectrum by sensitizers for known photolyzable organic halogen compounds. Exemplary sensitizers include aromatic amines and colored aromatic polycyclic hydrocarbons, as described, for example, in U.S. Pat. No. 4,250,053 (Smith), the disclosure of which is incorporated herein by reference.

Suitable photoactivatable organometallic complex salts useful in the present invention include those described, for example, in U.S. Pat. No. 5,059,701 (Keipert); U.S. Pat. No. 5,191,101 (Palazzotto et al.); and U.S. Pat. No. 5,252,694 (Willett et al.), the disclosures of which are incorporated herein by reference.

Exemplary organometallic complex cations useful as photoactivatable catalysts in the present invention include:

($\eta^6$-benzene)($\eta^5$-cyclopentadienyl)$Fe^{+1}$ $SbF_6^-$, ($\eta^6$-toluene)($\eta^5$-cyclopentadienyl)$Fe^{+1}$ $AsF_6^-$, ($\eta^6$-xylene)($\eta^5$-cyclopentadienyl)$Fe^{+1}$ $SbF_6^-$, ($\eta^6$-cumene)($\eta^5$-cyclopentadienyl)$Fe^{+1}$ $PF_6^-$, ($\eta^6$-xylenes (mixed isomers))($\eta^5$-cyclopentadienyl)$Fe^{+1}$ $SbF_6^-$, ($\eta^6$-xylenes (mixed isomers))($\eta^5$-cyclopentadienyl)$Fe^{+1}$ $PF_6^-$, ($\eta^6$-o-xylene)($\eta^5$-cyclopentadienyl)$Fe^{+1}$ $CF_3$ $SO_3^-$, ($\eta^6$m-xylene)($\eta^5$-cyclopentadienyl)$Fe^{+1}$ $BF_4^-$, ($\eta^6$-mesitylene)($\eta^5$-cyclopentadienyl)$Fe^{+1}$ $SbF_6^-$, ($\eta^6$-hexamethylbenzene)($\eta^5$-cyclopentadienyl)$Fe^{+1}$ $SbF_5OH^-$, and ($\eta^6$-fluorene)($\eta^5$-cyclopentadienyl)$Fe^{+1}$ $SbF_6^-$.

Desired salts of organometallic complex cations useful in the present invention include one or more of the following: ($\eta^6$-xylenes (mixed isomers))($\eta^5$-cyclopentadienyl)$Fe^{+1}$ $SbF_6^-$, ($\eta^6$-xylenes (mixed isomers))($\eta^5$-cyclopentadienyl)$Fe^{+1}$ $PF_6^-$, ($\eta^6$-xylene)($\eta^5$-cyclopentadienyl)$Fe^{+1}$ $SbF_6^-$, and ($\eta^6$-mesitylene)($\eta^5$-cyclopentadienyl)$Fe^{+1}$ $SbF_6^-$.

Optionally, organometallic salt initiators can be accompanied by an accelerator such as an oxalate ester of a tertiary alcohol. If present, the accelerator desirably comprises from about 0.1 to about 4 percent by weight of the total binder precursor, more desirably about 60 percent of the weight of the metallocene initiator.

Useful commercially available photocatalysts include an aromatic sulfonium complex salt, available, for example, under the trade designation "FX-512" from Minnesota Mining and Manufacturing Company, St. Paul, Minn., and an aromatic sulfonium complex salt having the trade designation "UVI-6974", available from Dow Chemical Co.

Optional photoinitiators useful in the practice of invention include those known as useful for photocuring free-radically polyfunctional acrylates. Exemplary photoinitiators include benzoin and its derivatives such as α-methylbenzoin; U-phenylbenzoin; α-allylbenzoin; α-benzylbenzoin; benzoin ethers such as benzil dimethyl ketal (available, for example, under the trade designation "IRGACURE 651" from Ciba Specialty Chemicals), benzoin methyl ether, benzoin ethyl ether, benzoin n-butyl ether; acetophenone and its derivatives such as 2-hydroxy-2-methyl-1-phenyl-1-propanone (available, for example, under the trade designation "DAROCUR 1173" from Ciba Specialty Chemicals) and 1-hydroxycyclohexyl phenyl ketone (available, for example, under the trade designation "IRGACURE 184" from Ciba Specialty Chemicals); 2-methyl-1-[4-(methylthio)phenyl]-2-(4-morpholinyl)-1-propanone (available, for example, under the trade designation "IRGACURE 907" from Ciba Specialty Chemicals); 2-benzyl-2-(dimethlamino)-1-[4-(4-morpholinyl)phenyl]-1-butanone (available, for example, under the trade designation "IRGACURE 369" from Ciba Specialty Chemicals).

Other useful photoinitiators include pivaloin ethyl ether, anisoin ethyl ether; anthraquinones, such as anthraquinone, 2-ethylanthraquinone, 1-chloroanthraquinone, 1,4-dimethylanthraquinone, 1-methoxyanthraquinone, benzanthraquinonehalomethyltriazines, and the like; benzophenone and its derivatives; iodonium salts and sulfonium salts as described hereinabove; titanium complexes such as bis($\eta_5$-2,4-cyclopentadien-1-yl)bis[2,6-difluoro-3-(1H-pyrrol-1-yl)phenyl]titanium (commercially available under the trade designation "CGI784 DC", also from Ciba Specialty Chemicals); halomethylnitrobenzenes such as 4-bromomethylnitrobenzene and the like; mono- and bis-acylphosphines (available, for example, from Ciba Specialty Chemicals under the trade designations "IRGACURE 1700", "IRGACURE 1800", "IRGACURE 1850", and "DAROCUR 4265").

Photoinitiators and photocatalysts useful in the present invention can be present in an amount in the range of 0.01 to 10 weight percent, desirably 0.01 to 5, most desirably 0.1 to 2 weight percent, based on the total amount of photocurable (i.e., crosslinkable by electromagnetic radiation) components of the binder precursor, although amounts outside of these ranges may also be useful.

Optionally, thermal curative may be included in the binder precursor. Desirably, such thermal curative is thermally stable at temperatures at which mixing of the components takes place. Exemplary thermal curatives for epoxy resins and acrylates are well known in the art, and are described, for example, in U.S. Pat. No. 6,258,138 (DeVoe et al.), the disclosure of which is incorporated herein by reference. Thermal curative may be present in a binder precursor in any effective amount. Such amounts are typically in the range of about 0.01 parts to 5 parts, desirably in the range from about 0.025 to 2 parts by weight, based upon 100 total parts by weight of the binder precursor, although amounts outside of these ranges may also be useful.

In addition to other components, the various layers, especially make and size layers, of coated abrasive articles according to the present invention may contain optional additives, for example, to modify performance and/or appearance. Exemplary additives include grinding aids, fillers, plasticizers, wetting agents, surfactants, pigments, coupling agents, fibers, lubricants, thixotropic materials, antistatic agents, suspending agents, pigments, and dyes.

Exemplary grinding aids, which may be organic or inorganic, include waxes, halogenated organic compounds such as chlorinated waxes like tetrachloronaphthalene, pentachloronaphthalene, and polyvinyl chloride; halide salts such as sodium chloride, potassium cryolite, sodium cryolite, ammonium cryolite, potassium tetrafluoroborate, sodium tetrafluoroborate, silicon fluorides, potassium chloride, magnesium chloride; and metals and their alloys such as tin, lead, bismuth, cobalt, antimony, cadmium, iron, and titanium; and the like. Examples of other grinding aids include sulfur, organic sulfur compounds, graphite, and metallic sulfides. A combination of different grinding aids can be used such as that described, for example, in U.S. Pat. No. 5,552,225 (Ho), the disclosure of which is incorporated herein by reference.

Exemplary antistatic agents include graphite, carbon black, vanadium oxide, humectants, and the like.

Examples of useful fillers for this invention include silica such as quartz, glass beads, glass bubbles and glass fibers; silicates such as talc, clays, (montmorillonite) feldspar, mica, calcium silicate, calcium metasilicate, sodium aluminosilicate, sodium silicate; metal sulfates such as calcium sulfate, barium sulfate, sodium sulfate, aluminum sodium sulfate, aluminum sulfate; gypsum; vermiculite; wood flour; aluminum trihydrate; carbon black; aluminum oxide; titanium dioxide; cryolite; chiolite; and metal sulfites such as calcium sulfite. Desired fillers are feldspar and quartz.

It is also within the scope of the present invention to have additional coatings (e.g., saturant, backsize layer, presize layer, tie layer, supersize layer), which may, for example, be present as continuous or discontinuous layers as dictated by the function or purpose of the material as known to one skilled in the art. For example, it may be desirable to provide a saturation coat to smooth the inherent textured surface of the paper backing material, particularly if utilizing fine grades of abrasive (e.g., ANSI grade 400 or finer). A backsize layer, which is applied to the back side of the backing, that is, the side opposite to which the abrasive particles are applied, adds body to the backing material and protects the backing material from wear. A presize layer is similar to a saturation coat except that it is applied to a previously treated backing. A supersize layer, that is, a coating applied on at least a portion of the size layer, can be added to provide, for example, a grinding aid, and/or as an anti-loading coating.

Further, with regard to the optional supersize layer, it may serve to prevent or reduce the accumulation of swarf (the material abraded from a workpiece) between abrasive particles which can dramatically reduce the cutting ability of the coated abrasive article. Useful supersize layers desirably include a grinding aid (e.g., potassium tetrafluoroborate), metal salts of fatty acids (e.g., zinc stearate or calcium stearate), salts of phosphate esters (e.g., potassium behenyl phosphate), phosphate esters, urea-formaldehyde resins, mineral oils, crosslinked silanes, crosslinked silicones, and/or fluorochemicals. Useful supersize materials are further described, for example, in U.S. Pat. No. 5,556,437 (Lee et al.), the disclosure of which is incorporated herein by reference.

An optional backsize layer can be applied to the backing. Exemplary backsize materials include a binder containing dispersed filler particles, and/or a pressure-sensitive adhesive.

The make layer, size layer, slurry layer, backsize layer, presize layer, supersize layer, saturant, tie layer, etc. may also contain electrically conductive material such as vanadium pentoxide (e.g., dispersed in a sulfonated polyester), carbon black and/or graphite in a binder (see, e.g., U.S. Pat. No. 5,108,463 (Buchanan); U.S. Pat. No. 5,137,542 (Buchanan et al.); and U.S. Pat. No. 5,203,884 (Buchanan et al.), the disclosures of which are incorporated herein by reference).

Methods for making coated abrasive articles are well known in the art.

In one method, coated abrasive articles according to the present invention can be made by applying a make layer comprising a first binder precursor onto at least a portion of a major surface of a backing. Abrasive particles are then applied to the make layer (e.g., by drop coating or electrostatic coating). The abrasive particles can be applied or placed randomly or in a precise pattern onto the make layer. The make layer is then cured at least sufficiently to retain the abrasive particles for the application of a size layer. The size layer comprises a second binder precursor (which may be the same as or different from the make layer binder precursor), and is applied over the make layer and abrasive particles. The second binder precursor is then cured (and, if necessary, the make layer is further cured alone or in combination with the size layer) sufficiently to make a useful coated abrasive article.

In another method, coated abrasive articles according to the present invention can be made by applying a layer of a slurry comprising binder precursor and abrasive particles onto at least a portion of a major surface of a backing. The slurry layer is then cured sufficiently to make a useful coated abrasive article.

Desirably, make, size and/or slurry layers are cured by actinic radiation.

Methods for applying make, size, and/or slurry layers to the backing are well known in the art and include, for example, roll coating (e.g., using soft rubber rolls), curtain coating, transfer coating, gravure coating, spraying, knife, die coating. Abrasive layers may be applied to the backing in a uniform or patterned manner, and may be continuous or discontinuous.

Desirably, if utilizing binder precursors comprising solid components, such precursors may be prepared by mixing some or all of the various ingredients of a binder precursor in a suitable vessel at an elevated temperature, for example, less than about 100° C., sufficient to liquify the materials so that they may be efficiently mixed, with stirring, to form the binder precursor, but without thermally degrading them.

Binder precursors employed in practice of the present invention may be cured by exposure to thermal energy, such as heat or infrared radiation. Exemplary sources of thermal energy include ovens, heated rolls, infrared lamps, etc. If thermal energy is employed, it is desirably kept to a minimum (e.g., backing temperatures of less than 100° C.) so that thermal expansion of the backing is minimized.

Desirably, binder precursors employed in practice of the present invention may be cured by exposure to actinic radiation. In such cases, curing of the binder precursor typically begins upon exposure of the binder precursor to an appropriate source of actinic radiation, and may continue for a period of time thereafter. The energy source is selected for the desired processing conditions and to appropriately activate any optional photoinitiator and/or optional photocatalyst. Exemplary useful sources of ultraviolet and visible radiation include mercury, xenon, carbon arc, tungsten filament lamps, and sunlight. Ultraviolet radiation, especially from a medium pressure mercury arc lamp or a microwave driven H-type, D-type, or V-type mercury lamp, such as of those commercially available from Fusion UV Systems, Gaithersburg, Md., is especially desirable.

Exposure times may range, for example, from less than about 1 second to 10 minutes or more, desirably providing a total energy exposure from about 0.1 to about 10 Joules per square centimeter ($J/cm^2$) depending upon the amount and the type of reactants involved, the energy source, web speed, the distance from the energy source, and the thickness of the make layer to be cured. Filters and/or dichroic reflectors may be used to reduce thermal energy that accompanies the actinic radiation.

Binder precursors employed in practice of the present invention may be cured by exposure to electron beam radiation. The dosage necessary is generally from less than 1 megarad to 100 megarads or more. The rate of curing may tend to increase with increasing amounts of photocatalyst and/or photoinitiator at a given energy exposure or by use of electron beam energy with no photoinitiator. The rate of curing also may tend to increase with increased energy intensity.

Advantageously, make layers, size layers, and/or slurry layers utilized in practice of the present invention typically reach a useful level of cure using actinic and/or electron beam radiation without the need for a post-exposure curing step with heat, such as in an oven.

Coated abrasive articles according to the present invention can be converted, for example, into belts, tapes, rolls, discs (including perforated discs), and/or sheets. For belt applications, two free ends of the abrasive sheet may be joined together using known methods to form a spliced belt. A spliceless belt may also be formed as described, for example, in U.S. Pat. No. 5,573,619 (Benedict et al.), the disclosure of which is incorporated herein by reference.

The second major surface of the backing opposite the abrasive layer may be secured to a refastenable layer. For example, a refastenable layer may be secured (e.g., heat laminated or adhesively secured to the backing). The refastenable layer may be secured to the backing prior to the application of the make layer precursor or alternatively, for example, the refastenable layer may be secured to the backing after the application of the abrasive layer.

The refastenable layer may comprise a plurality of hooks or loops (e.g., fiber loops), typically in the form of a sheet-like substrate having a plurality of hooks or loops protruding from the back side of the substrate. The hooks or loops provide a means of engagement between the coated abrasive article and a support pad that contains a complimentary hook or loop surface.

The refastenable layer may also comprise a stem web as described, for example, in U.S. Pat. No. 5,672,186 (Chesley et al.), the disclosure of which is incorporated herein by reference.

Coated abrasive articles according to the present invention are useful for abrading a workpiece. One such method includes the step of frictionally contacting a coated abrasive article with a surface of the workpiece, and moving at least one of the coated abrasive article or the workpiece relative to the other to abrade at least a portion of the surface. Examples of workpiece materials include metal, metal alloys, exotic metal alloys, ceramics, glass, wood, wood-like materials, composites, painted surfaces, plastics, reinforced plastics, stone, and/or combinations thereof. The workpiece may be flat or have a shape or contour associated with it. Exemplary workpieces include metal components, plastic components, particleboard, camshafts, crankshafts, furniture, and turbine blades.

Coated abrasive articles according to the present invention may be used by hand and/or used in combination with a machine. At least one or both of the coated abrasive article and the workpiece is moved relative to the other when abrading.

In another aspect, abrading may be conducted under wet or dry conditions. Exemplary liquids for wet abrading include water, water containing conventional rust inhibiting compounds, lubricant, oil, soap, and cutting fluid. The liquid may also contain defoamers, degreasers, and/or the like.

The present invention will be more fully understood with reference to the following nonlimiting examples in which all parts, percentages, ratios, and so forth, are by weight unless otherwise indicated.

EXAMPLES

The following abbreviations are used in the examples:

"3-MPTS" refers to 3-methacryloxypropyltrimethoxysilane having the trade designation "A174", available from Dow Chemical Co., Midland, Mich.;

"ABR1" refers to aluminum oxide abrasive particles having the trade designation "ALUDOR P80 FRPL", obtained from Treibacher Chemische Werke AG, Villach, Austria;

"ABR2" refers to blended mineral abrasive particles consisting of 70 parts aluminum oxide and 30 parts of a sol-gel seeded aluminum oxide having the trade designation "ALUDOR P220 BFRPL", obtained from Treibacher Chemische Werke AG;

"ACR1" refers to Bisphenol-A epoxy diacrylate, acrylate functionality=2, molecular weight=500 g/mol, having the trade designation "EBECRYL 3720", available from UCB Chemicals Corp., Smyrna, Ga.;

"ACR2" refers to trimethylolpropane triacrylate having the trade designation "TMPTA-N", obtained from UCB Chemicals Corp.;

"AMOX" refers to di-t-amyl oxalate, which can be made by esterification of oxalic acid with t-amyl alcohol as described in Example 11 of U.S. Pat. No. 4,904,814 (Frei et al.), the disclosure of which is incorporated herein by reference;

"CAST" refers to a 55 percent aqueous calcium stearate solution having the trade designation "E-CHEM 1058", obtained from E-Chem Co., Leeds, England;

"CHDM" refers to 1,4-cyclohexanedimethanol, obtained from Eastman Chemical Co., Kingsport, Conn.;

"EP 1" refers to a cycloaliphatic epoxide resin (average epoxy functionality of 2), having the trade designation "CYRACURE UVR-6110", available from Dow Chemical Co.;

"EP2" refers to a cycloaliphatic epoxide resin (average epoxy functionality of 2), having the trade designation "CYRACURE UVR-6110AA", available from Dow Chemical Co.;

"EP3" refers to a novolac epoxy resin having an epoxy equivalent weight of 172–179 g/equivalent (i.e., g/eq), an average epoxy functionality of 2.2, and having the trade designation "DEN 431", available from Dow Chemical Co.;

"EP4" refers to a novolac epoxy resin having an epoxy equivalent weight of 176–181 g/eq, an average epoxy functionality of 3.6, and having the trade designation "DEN 438", available from Dow Chemical Co.;

"EP5" refers to a novolac epoxy resin, having an epoxy equivalent weight of 191–210 g/eq, an average epoxy functionality of 3.8, and having the trade designation "DEN 439", available from Dow Chemical Co.;

"EP6" refers to a Bisphenol-A epoxy resin having an epoxy equivalent weight of 185–192 g/eq, an average epoxy functionality of 2, having the trade designation "EPON 828", available from Resolution Performance Products, Houston, Tex.;

"EP7" refers to a Bisphenol-A epichlorohydrin based epoxy resin having an epoxy equivalent weight of 525–550 g/eq, an average epoxy functionality of 2, and having the trade designation "EPON 1001F", available from Resolution Performance Products;

"EP8" refers to an epoxy Bisphenol A novolac solid resin, 187–207 g/eq, having an average epoxy functionality of 3, and having the trade designation "EPON RESIN SU-3", available from Resolution Performance Products;

"EP9" refers to 3,4-epoxycyclohexylmethyl 3,4-epoxycyclohexenecarboxylate (average epoxy functionality of 2) having the trade designation "ERL 4221", available from Dow Chemical Co.;

"EP10" refers to bis(3,4-epoxycyclohexyl) adipate (average epoxy functionality of 2) having the trade designation "ERL 4299", available from Dow Chemical Co.;

"NM" means not measured;

"PC1" refers to η-[xylenes (mixed isomers)]-η-cyclopentadienyliron(II) hexafluoroantimonate, which can be prepared according to methods as described, for example, in U.S. Pat. No. 5,059,701 (Keipert), the disclosure of which is incorporated herein by reference;

"PC2" refers to triarylsulfonium hexafluoroantimonate 50 weight percent in propylene carbonate, having the trade designation "SARCAT CD 1010", obtained from Sartomer Co., Exton, Pa.;

"PC2" refers to triarylsulfonium hexafluorophosphate, 50 weight percent in propylene carbonate, having the trade designation "SARCAT CD 1011", obtained from Sartomer Co., Exton, Pa.;

"PC3" refers to triarylsulfonium hexafluoroantimonate, 50 weight percent in propylene carbonate, having the trade designation "UVI-6974", available from Dow Chemical Co.;

"PEP" refers to a high molecular weight hydroxy-terminated, saturated, linear, semicrystalline copolyester, $M_w$=35,000 g/mol, having the trade designation "DYNAPOL S1227", available from Creanova, Piscataway, N.J.;

"PI1" refers to 2-hydroxy-2-methyl-1-phenyl-1-propanone having the trade designation "DAROCUR 1173", available from Ciba Specialty Chemicals, Tarrytown, N.Y.;

"PI2" refers to 2,2-dimethoxy-1,2-diphenyl-1-ethanone which is a photoinitiator having the trade designation "IRGACURE 651", available from Ciba Specialty Chemicals;

"PI3" refers to 2,4,6-trimethylbenzoyldiphenylphosphine oxide photoinitiator having the trade designation "LUCIRIN TPO", available from BASF Chemicals Corp., Ludwigshafen, Germany;

"SPAL" refers to anhydrous sodium potassium aluminosilicate having the trade designation "MINEX 3", available from L. V. Lomas, Ltd., Brampton, Ontario, Canada; and "ZNST" refers to a supersize consisting of a mixture of 18.35 parts water, 0.31 parts cellulose gum (obtained under the trade designation "HERCULES CMC-7M" from Aqualon Co., Savannah, Ga.), 6.36 parts acrylic copolymer (obtained under the trade designation "CARBOSET GA-1087" from B. F. Goodrich Co., Cleveland, Ohio), 0.54 parts anti-foam agent (obtained under the trade designation "ADVANTAGE 1512" from Hercules, Savannah, Ga.), 0.54 parts antifoam (obtained under the trade designation "ANTIFOAM HL-27" from Harcros Chemicals, Kansas City, Kans.), 73.9 parts zinc stearate (obtained under the trade designation "ZINC STEARATE NB-60M" from Crompton Corp. Greenwich, Conn.).

All parts, percentages and ratios in the examples are by weight unless stated otherwise.

Unless otherwise noted, all reagents used in the examples were obtained, or are available from, general chemical suppliers such as Aldrich Chemical Co., Milwaukee, Wis., or may be synthesized by known methods.

Test Procedures

The following test procedures were used to evaluate resin compositions and coated abrasive articles of the present invention.

Curl Test

A template having multiple circular arcs of varying radii of curvature was vertically mounted. The sample to be tested as a 15.2 centimeter (i.e., cm) diameter disc was placed vertically against the template such that the profile of the disc, if viewed edge-wise, falls along an indicated arc. The radius of curvature of the closest matching arc was recorded. Results are reported as the average value of 3 measurements.

Generally, referring to coated abrasive discs, larger values of the radius of curvature are desirable. A measured radius of curvature of about 2.5 cm or less is indicative of a sample having a "tube" form as illustrated, for example, in FIG. 1. A measured radius of curvature of about 50 cm or greater is indicative of a "flat" sample.

Knoop Hardness Test

The indention hardness test is described in ASTM Test No. D 1474-85 (Method A), the disclosure of which is incorporated herein by reference, using a hardness tester obtained under the trade designation "TUKON" model 200, from Wilson Instruments, Binghampton, N.Y. Resin compositions utilized for the present invention were coated onto glass microscope slides at a thickness of approximately 0.23 millimeter. The coatings were cured by passing two times through a UV (i.e., ultraviolet) Processor, obtained under the trade designation "EPIQ 6000", from Fusion UV Systems, using a D-type bulb at 0.9 J/cm$^2$ and 6.1 meters per minute. Comparative compositions were subsequently thermally cured at 120° C. for 10 minutes. A pyramidal-shaped diamond stylus at a load of 100 grams (g) was applied along the surface of the coating, resulting in a permanent indentation. The length of the permanent indentation in the coating, taken as an average of 3 measurements, was then converted into a Knoop Hardness Number according to the procedure of ASTM Test No. D 1474-85 (Method A).

Dry Schiefer Test

Abrasive coatings were laminated to a looped backing (referred to by the trade designation "3M HOOKIT II" from Minnesota Mining and Manufacturing Company), and die cut into 10.2 cm diameter discs. The back-up pad was secured to the driven plate of a Schiefer Abrasion Tester, obtained from Frazier Precision Co., Gaithersburg, Md. Donut-shaped shaped acrylic plastic workpieces, 10.2 centimeter outside diameter by 1.27 cm thickness, were obtained under the trade designation "POLYCAST" from Sielye Plastics, Bloomington, Minn. The initial weight of each workpiece was recorded to the nearest milligram (mg) prior to mounting on the workpiece holder of the Shiefer tester. A 4.54 kilogram (kg) weight was placed on the abrasion tester weight platform and the mounted abrasive specimen lowered onto the workpiece and the machine turned on. The machine was set to run for 500 cycles and then automatically stop. After each 500 cycles of the test, the workpiece was wiped free of debris and weighed. The cumulative cut for each 500-cycle test was the difference between the initial weight and the weight following each test, and is reported as the average value of 4 measurements.

Wet Schiefer Test

Coated abrasives were laminated to a looped backing ("3M HOOK-IT II"), and die cut into 10.2 cm diameter discs. The laminated coated abrasive was secured to the driven plate of a Schiefer Abrasion Tester, obtained from Frazier Precision Co., Gaithersburg, Md., which had been plumbed for wet testing. Disc shaped acrylic plastic workpieces, 10.2 centimeter outside diameter by 1.27 cm thickness, available under the trade designation "POLYCAST" were obtained from Sielye Plastics, Bloomington, Minn. The initial weight of each workpiece was recorded to the nearest milligram (i.e., mg) prior to mounting on the workpiece holder of the Shiefer tester. The water flow rate was set to 60 grams per minute. A 4.54 kg weight was placed on the abrasion tester weight platform and the mounted abrasive specimen lowered onto the workpiece and the machine turned on. The machine was set to run for 500 cycles and then automatically stop. After each 500 cycles of the test, the workpiece was wiped free of debris and weighed. The cumulative cut for each 500-cycle test was the difference between the initial weight and the weight following each test, and is reported as the average value of 4 measurements.

Off-Hand Dual Action Abrasion Test

Circular specimens (15.2 cm diameter) were cut from the abrasive material to be tested, and attached to a dual action sander with the sanding disc positioned at approximately 5 degrees to the surface of the workpiece, obtained from National Detroit, Rockford, Ill. Abrasion tests were run for 3 minutes at a sander pressure of 413 kiloPascals, on black base coat/clear coat painted cold rolled steel panels (E-coat: ED5000; Primer: 764–204; Base coat: 542AB921; Clear coat: K8010A) obtained from ACT Laboratories, Hillsdale, Mich. The cut, reported in grams, is the weight loss of the workpiece, and is reported as the average value of 3 measurements.

High Angle/High Pressure Off-Hand Abrasion Test

This test was performed according to the Off-Hand Dual Action Abrasion test, except that the sander was operated at an angle of 15 degrees relative to the workpiece at a sander pressure of 550 kiloPascals. The cumulative cut was measured after sanding for 2 minutes in one-minute intervals, and is reported as the average value of 2 measurements.

Surface Finish Test $R_a$ is a common measure of roughness used in the abrasives industry. $R_a$ is the arithmetic mean of the departures of the roughness profile from the mean line. $R_a$ was measured with a profilometer probe, which was a diamond tipped stylus, at five locations and the arithmetic mean was calculated as the average of these five measurements. In general, the lower the $R_a$ value, the smoother or finer the workpiece surface finish. The results are reported in micrometers. The profilometer was obtained under the trade designation "SURTRONIC 3" from Rank Taylor Hobson Co., Leicester, England.

$R_z$ is a common measure of roughness used in the abrasives industry. $R_z$ is defined as the Ten Point Roughness Height, which is the average of the five greatest vertical peak-to-valley height differences within one cutoff length. $R_z$ was measured with the same equipment as the $R_a$ value. The results are reported in micrometers. In general, the lower the $R_z$, the smoother the finish.

Preparation of Make Resin A

A make resin consisting of EP6 (35 parts by weight), AMOX (0.6 part by weight), ACR2 (6 parts by weight), CHDM (2.8 parts by weight), EP7 (26 parts by weight), PEP (28 parts by weight), P12 (1 part by weight) and PC1 (0.6 part by weight) was prepared as follows:

EP6, ACR2, and CHDM were placed into a container. The mixture was then placed into a water bath having a temperature in the range of from 60 to 75° C. while mixing. The P12, AMOX, and PC 1 were then added with mixing. The resulting premix was then placed in a liquid feeder and mixed with the PEP and EP7 pellets in a twin screw extruder at the time of coating.

Preparation of Size Resins 1–2 and Size Resin A

Table 1 (below) lists the components and their amounts used to formulate Size Resins 1–3.

TABLE 1

| INGREDIENT | SIZE RESIN 1, parts by weight | SIZE RESIN 2, parts by weight | SIZE RESIN A, parts by weight |
|---|---|---|---|
| ACR2 | 70.0 | 70.0 | 28.8 |
| ACR1 | 2.0 | 2.0 | 0 |
| EP5 | 0 | 21.4 | 0 |
| EP8 | 21.4 | 0 | 0 |
| EP9 | 8.57 | 8.57 | 67.2 |
| PI3 | 2.0 | 2.0 | 0 |
| PC3 | 2.0 | 2.0 | 3 |
| 3-MPTS | 2.0 | 2.0 | 0 |
| SPAL | 44.6 | 44.6 | 0 |
| PI1 | 0 | 0 | 1 |

Size Resin A was prepared by mixing all the components and stirring until homogeneous.

Size Resins 1 and 2 were prepared by heating the EP5, SU3, and ACR1 to 100° C., and then mixing with them with the remaining ingredients.

Examples 1–5 and Comparative Example 1

Examples 1–5 and Comparative Example 1 were prepared as follows. In a continuous process, Make Resin A was die extrusion coated onto a corona treated (in ambient air using a 1.8 mm electrode gap, 1.5 kilowatts power, and a web speed of 50 meters/minute) polypropylene web (0.25 mm thickness) at a nominal coating weight of 20 g/m$^2$. The coated web was then passed at a line speed of 30 meters per minute under a Fusion UV Systems 600W/in V-bulb operating at 100 percent power (nominal UVA dosage was 0.5 J/cm$^2$). Next, ABR2 abrasive particles were coated onto the make layer at a nominal coating weight of 65 g/m$^2$, and the web was passed under three radiant infrared heaters, obtained from Glenro Co., Paterson, N.J., at a nominal web temperature setting of 115° C. for 7.3 seconds. A size layer was then roll coated onto the make layer and abrasive particles and passed under two Fusion UV Systems 600W/in D-bulbs operating at 85 percent power (nominal UVA dosage was 0.4 J/cm$^2$). For Comparative Example 1, the sample was also passed under three radiant infrared heaters as before sufficient to achieve a nominal web temperature of 90° C., 100° C., and 115° C., respectively (2.4 seconds duration per zone). ZNST was then roll coated onto the size layer at a nominal dry weight of 17 g/m$^2$ and allowed to air dry off line overnight. The resultant coated abrasive articles were maintained at room temperature (i.e., 20° C.–24° C.) and 40 to 60 percent relative humidity until tested.

Process conditions and various performance results are listed in Table 2 (below).

TABLE 2

| | Comparative Example 1 | Example 1 | Example 2 | Example 3 | Example 4 | Example 5 |
|---|---|---|---|---|---|---|
| SIZE RESIN USED | Size Resin A | Size Resin 1 | Size Resin 1 | Size Resin 2 | Size Resin 2 | Size Resin 2 |
| Size Layer Weight, g/m$^2$ | 66.5 | 26 | 58 | 88.5 | 42.5 | 46 |
| Size Layer IR Cure, ° C. | 3 zones (115) | none | none | none | none | none |
| Dry Schiefer Test Cut, g | 2.52 | 2.24 | 2.7 | 2.46 | 2.71 | 2.53 |
| $R_a$, micrometers | 2.04 | 1.19 | 1.65 | 1.82 | 1.44 | 1.60 |
| $R_z$, micrometers | 12.0 | 7.4 | 10.0 | 10.8 | 9.1 | 9.7 |
| Off-hand Cut, g | 3.327 | 5.843 | 7.547 | 5.57 | 8.053 | 7.313 |
| Immediate Curl Radius, cm | 20 | 51 | 19 | 13 | 51 | 20 |
| 1 day Curl Radius, cm | 2.5 | 19 | 5.5 | 14 | 11 | 13 |
| 2 day Curl Radius, cm | 2 | 12 | 13 | 8.9 | 8.4 | 11 |
| 1 week Curl Radius, cm | 1.8 | 8.9 | 15 | 9.4 | 6.9 | 13 |
| 2 weeks Curl Radius, cm | 1.8 | 7.9 | 15 | 9.7 | 6.1 | 12 |

Preparation of Make Resins I-XIII and Make Resin B

Make Resins I-XIII and Make Resin B, the formulations of which are given in Tables 3 and 4 (below), were formulated according to the following procedure. Knoop hardness numbers for the cured make resins are also reported in Tables 3 and 4.

Pellets of EP7and PEP pellets were mixed, with occasional stirring, at 120° C. for approximately 4 hours, until homogeneous. In a separate container, the remaining epoxy monomers were heated to 66° C., and EP1, CHDM, and ACR2 were added with mixing. This mixture was then added to the EP7/PEP composition and stirred until homogeneous. Photocatalysts, photoinitiators, initiators and any additional ingredients were then added with constant stirring until the make resin was thoroughly mixed.

Make Resins I-XIII and Make Resin B were cured according to the conditions described in the Knoop Hardness Test (above).

Figure 1:
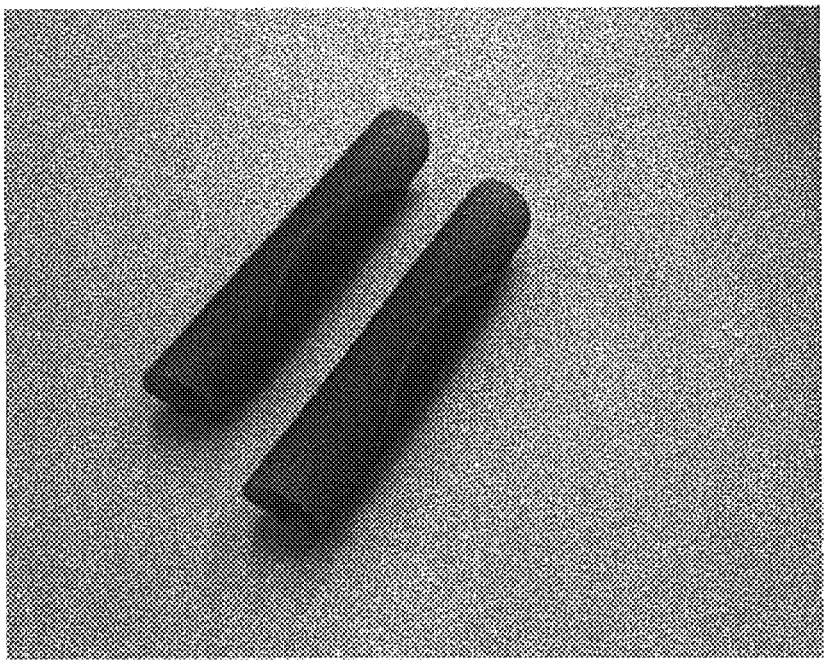
FIG. 1 (Prior Art)
FIG. 1 is a photograph of two prior art coated abrasive discs having make and size layers and a polypropylene backing.

Two discs prepared according to Comparative Example 1 were maintained at room temperature (i.e., 20° C.–24° C.) and 40 to 60 percent relative humidity for 4 weeks and photographed, as shown in FIG. 1.

Figure 3:
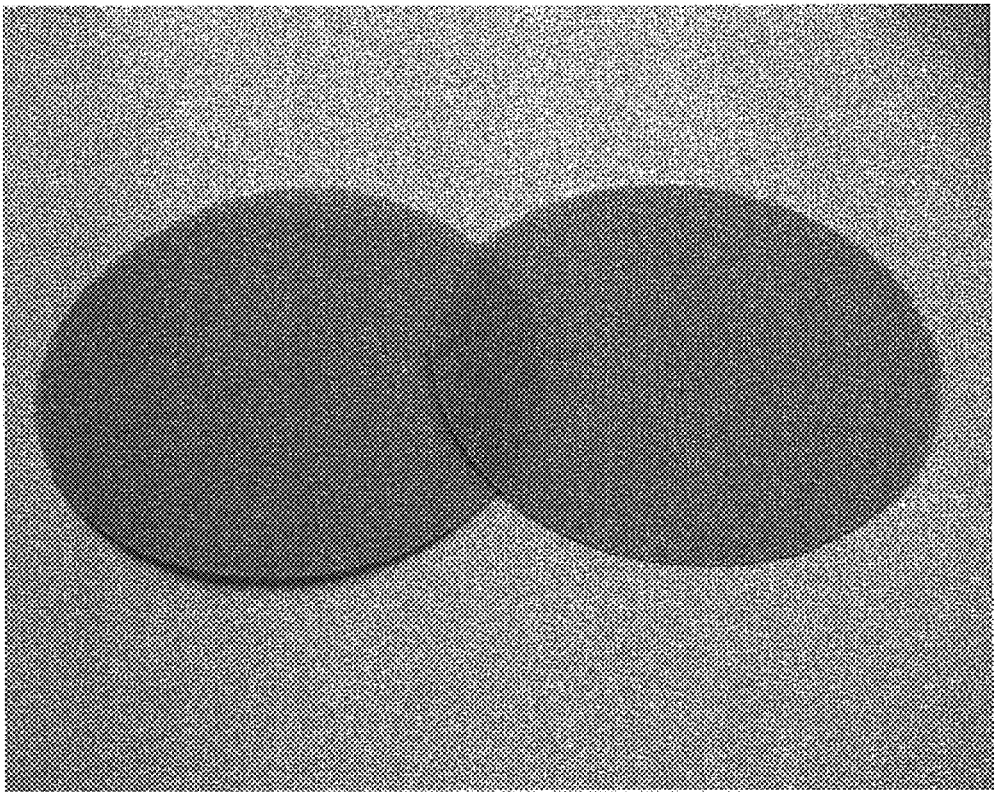
FIG. 3 is a photograph of two coated abrasive discs according to the present invention having make and size layers and a polypropylene backing.

Two discs prepared according to Example 5 were maintained at room temperature (i.e., 20° C.–24° C.) and 40 to 60 percent relative humidity for 4 weeks and photographed, as shown in FIG. 3.

TABLE 3

| | MAKE RESIN, parts by weight | | | | | | | |
|---|---|---|---|---|---|---|---|---|
| INGREDIENT | B | I | II | III | IV | V | VI | VII |
| ACR2 | 9 | 10 | 20 | 20 | 10 | 10 | 5.1 | 15 |
| EP1 | 0 | 20 | 10 | 0 | 0 | 0 | 10.2 | 2 |

TABLE 3-continued

| INGREDIENT | MAKE RESIN, parts by weight | | | | | | | |
|---|---|---|---|---|---|---|---|---|
| | B | I | II | III | IV | V | VI | VII |
| EP2 | 0 | 0 | 0 | 0 | 0 | 20 | 0 | 0 |
| EP4 | 0 | 74 | 74 | 74 | 74 | 74 | 9.4 | 9.3 |
| EP6 | 71 | 0 | 0 | 0 | 0 | 0 | 28.3 | 27.8 |
| EP7 | 54 | 53 | 53 | 53 | 53 | 53 | 27.0 | 26.5 |
| EP10 | 0 | 0 | 0 | 10 | 20 | 0 | 0 | 0 |
| CHDM | 5.6 | 5 | 5 | 5 | 5 | 5 | 2.6 | 2.5 |
| PEP | 56 | 30 | 30 | 30 | 30 | 30 | 15.3 | 15 |
| PC1 | 1.2 | 0 | 0 | 0 | 0 | 0 | 0 | 0 |
| PC2 | 0 | 6 | 6 | 6 | 6 | 6 | 1.5 | 1.5 |
| PI2 | 2 | 0 | 0 | 0 | 0 | 0 | 0 | 0 |
| PI3 | 0 | 2 | 2 | 2 | 2 | 2 | 0.5 | 0.5 |
| AMOX | 1.2 | 0 | 0 | 0 | 0 | 0 | 0 | 0 |
| Knoop Hardness | 5.0 | 16.0 | 16.3 | 18.7 | 16.5 | NM | 18.6 | 12.0 |

TABLE 4

| INGREDIENT | MAKE RESIN, parts by weight | | | | | |
|---|---|---|---|---|---|---|
| | VIII | IX | X | XI | XII | XIII |
| ACR2 | 5.1 | 10.2 | 10.3 | 12.8 | 12.8 | 10.2 |
| EP1 | 10.3 | 5.1 | 5.1 | 2.6 | 2.6 | 5.1 |
| EP3 | 0 | 0 | 0 | 0 | 0 | 0 |
| EP4 | 9.5 | 9.4 | 9.5 | 9.4 | 9.5 | 9.4 |
| EP6 | 28.5 | 28.3 | 28.5 | 28.3 | 28.5 | 28.3 |
| EP7 | 27.2 | 27.0 | 27.2 | 27.0 | 27.2 | 27.0 |
| PI3 | 0.5 | 0.5 | 0.5 | 0.5 | 0.5 | 0.5 |
| PC2 | 0 | 0 | 0 | 0 | 0 | 1.5 |
| PC2 | 1.0 | 1.5 | 1.0 | 1.5 | 1.0 | 0 |
| CHDM | 2.6 | 2.6 | 2.6 | 2.6 | 2.6 | 2.5 |
| PEP | 15.4 | 15.3 | 15.4 | 15.3 | 15.4 | 15.3 |
| Knoop Hardness | 13.0 | 12.0 | 15.4 | 15.0 | 16.4 | 9.5 |

Examples 6–11 and Comparative Example 2

Make Resins I, II, III, V, IX, XIII and Make Resin B were used to prepare Examples 6–11 and Comparative Example 2, respectively, as described below. Each make resin was applied to 25.4 centimeter width C-type paper backing, ref. 5398 PO, obtained from Kimberly-Clark Co., Roswell, Ga., at 66° C. using a knife coater heated to 100° C., having a plate temperature of 82.2° C. and a 51 micrometer gap.

The resin coated papers were electrostatically coated with ABR1, at a coating weight of 180–210 g/m$^2$, and cured by passing once through, at a speed of 15.2 meters per minute, a UV Processor obtained under the trade designation "EPIQ 6000" from Fusion UV Systems, and equipped with a D-type bulb (UVA dosage was 0.9 J/cm$^2$ at web speed of 15.2 meters per minute).

A size material was prepared as follows. ACR2 (52.1 parts) and 7.5 parts EP1were mixed together at 100° C. To this was added 15.0 parts EP5, and the mixture stirred until dissolved. With continued stirring, 1.5 part P13, 1.5 part PC3 and 22.4 parts SPAL were dissolved in the size coat. The mixture was then cooled to 25° C. and dissolved in 50 parts acetone.

The size material was applied to the abrasive coated papers using a laboratory roll coater made by Eagle Tool Co., Minneapolis, MN, and dried for 15 minutes at 66° C. The resulting uncured size layer was cured as described above for the resin make layer. The resulting coated abrasive articles were laminated to a looped backing ("3M HOOK-IT II"), and die cut into 10.2 cm diameter discs.

Examples 6–11 and Comparative Example 2 were evaluated according to the Wet Schiefer Test. Example 6 and Comparative Example 2 Schiefer Test data are reported in Table 5 (below).

TABLE 5

| EXAMPLE | WET SCHIEFER CUT, g | $R_a$, micrometers | $R_z$, micrometers |
|---|---|---|---|
| Comparative Example 2 | 1.99 | 3.02 | 18.7 |
| 6 | 2.09 | 3.33 | 20.5 |
| 7 | 2.09 | 3.66 | 22.2 |
| 8 | 2.04 | 3.30 | 19.6 |
| 9 | 2.07 | 3.20 | 19.4 |
| 10 | 1.98 | 2.97 | 17.5 |
| 11 | 1.96 | 2.82 | 16.5 |

Examples 12–14 and Comparative Example 3

The make and size coating and curing steps described in Example 6, were repeated using Make Resins I, II, III, V and Make Resin B to prepare Examples 12–14 and Comparative Example 3, respectively, except that abrasive particles ABR1 was replaced with ABR2 blended mineral. A supersize coat comprising of CAST was then applied as a 45 weight percent aqueous solution using a roll coater equipped with a soft rubber roll and steel roll (with the soft roll against the abrasive layer), and dried for 15 minutes at 66° C. to provide a supersize layer weight of 15 g/m$^2$.

Off-Hand Dual Action and HAHP Off-Hand abrasion results reported in Table 6 (below). The reported Off-Hand Dual Action test results for Example 12 and Comparative Example 3 are an average of two test measurements.

TABLE 6

| EXAMPLE | OFF-HAND DUAL ACTION CUT, g | HAHP OFF-HAND CUT, g |
|---|---|---|
| Comparative Example 3 | 10.18 | 7.40 |
| 12 | 10.87 | 6.92 |
| 13 | 10.70 | NM |
| 14 | 10.59 | NM |

Examples 15–26

Coated abrasive discs were prepared using Make Resins VI-XIII according to the method described in Example 6 to give Examples 15–22, respectively. Examples 23–26 were prepared using Make Resins IX-XII according to the method described in Example 6, except that a curing web speed of 27.4 meters per minute was used corresponding to an actinic radiation dose of 0.5 J/cm$^2$. Table 7 (below) shows mineral adhesion as a function of make resin formulation and processing speed. The Mineral Adhesion Rating in Table 7 was determined by rubbing the abrasive surface with a thumb and using the scale (1–5): 5=excellent adhesion, little or no particles rubbed off; 4=very good, small amount of particles rubbed off; 3=good, many particles rubbed off; 2=fair, most of the particles rubbed off; 1=poor, 0=all particles rubbed off, no adhesion. In Examples 20–21 and 25–26, drop in mineral adhesion is attributed to rapid cure of the binder precursor prior to being coated with the abrasive mineral.

TABLE 7

| EXAMPLE | MAKE RESIN USED | UV PROCESSOR LINE SPEED, meters/minute | MINERAL PICK-UP | MINERAL ADHESION, 1–5 rating |
|---|---|---|---|---|
| 15 | VI | 15.2 | Excellent | 5 |
| 16 | VII | 15.2 | Excellent | 5 |
| 17 | VIII | 15.2 | Excellent | 3 |
| 18 | IX | 15.2 | Excellent | 5 |
| 19 | X | 15.2 | Excellent | 5 |
| 20 | XI | 15.2 | Excellent | 2 |
| 21 | XII | 15.2 | Excellent | 2 |
| 22 | XIII | 15.2 | Excellent | 5 |
| 23 | IX | 27.4 | Excellent | 5 |
| 24 | X | 27.4 | Excellent | 5 |
| 25 | XI | 27.4 | Excellent | 2 |
| 26 | XII | 27.4 | Excellent | 2 |

Various modifications and alterations of this invention will become apparent to those skilled in the art without departing from the scope and spirit of this invention, and it should be understood that this invention is not to be unduly limited to the illustrated embodiments set forth herein.

What is claimed is:

1. A coated abrasive article comprising:

a backing having a major surface; and an abrasive layer secured to at least a portion of the major surface, the abrasive layer comprising a binder and abrasive particles, wherein the binder comprises a reaction product of components comprising polyfunctional acrylate, aromatic polyepoxide having an average epoxy functionality of at least 2.5, and from about 1 to about 27 percent by weight alicyclic polyepoxide, based on the total combined weight of polyfunctional acrylate, alicyclic polyepoxide, and aromatic polyepoxide having an average epoxy functionality of at least 2.5.

2. A coated abrasive article comprising:

a backing having a major surface;

an abrasive layer secured to at least a portion of the major surface, the abrasive layer comprising:

a make layer comprising a first binder;

abrasive particles at least partially embedded in the make layer; and a size layer comprising a second binder, at least partially covering the abrasive layer, wherein at least one of the first or second binders comprise a reaction product of components comprising polyfunctional acrylate, aromatic polyepoxide having an average epoxy functionality of at least 2.5, and from about 1 to about 27 percent by weight alicyclic polyepoxide, based on the total combined weight of polyfunctional acrylate, alicyclic polyepoxide, and aromatic polyepoxide having an average epoxy functionality of at least 2.5.

3. The coated abrasive article of claim 2, wherein the components further comprise at least one photoinitiator.

4. The coated abrasive article of claim 2, wherein the components further comprise at least one photocatalyst.

5. The coated abrasive article of claim 2, wherein the components further comprise at least one photoinitiator and at least one photocatalyst.

6. The coated abrasive article of claim 2, wherein the coated abrasive article further comprises at least one of a backsize layer, supersize layer, presize layer, or saturant.

7. The coated abrasive article of claim 2, wherein the backing is polypropylene.

8. The coated abrasive article of claim 2, wherein the components comprise from about 5 to about 90 percent by weight polyfunctional acrylate, based on the total combined weight of polyfunctional acrylate, alicyclic polyepoxide, and aromatic polyepoxide having art average epoxy functionality of at least 2.5.

9. The coated abrasive article of claim 2, wherein the components comprise from about 20 to about 85 percent by weight polyfunctional acrylate, based on the total combined weight of polyfunctional acrylate, alicyclic polyepoxide, and aromatic polyepoxide having an average epoxy functionality of at least 2.5.

10. The coated abrasive article of claim 2, wherein the components comprise from about 60 to about 80 percent by weight polyfunctional acrylate, based on the total combined weight of polyfunctional acrylate, alicyclic polyepoxide, and aromatic polyepoxide having an average epoxy functionality of at least 2.5.

11. The coated abrasive article of claim 2, wherein the components comprise from about 6 to about 13 percent by weight alicyclic polyepoxide, based on the total combined weight of polyfunctional acrylate, alicyclic polyepoxide, and aromatic polyepoxide having an average epoxy functionality of at least 2.5.

12. The coated abrasive article of claim 2, wherein the components comprise from about 8 to about 12 percent by weight alicyclic polyepoxide, based on the total combined weight of polyfunctional acrylate, alicyclic polyepoxide, and aromatic polyepoxide having an average epoxy functionality of at least 2.5.

13. The coated abrasive article of claim 2, wherein the components comprise from about 6 to about 75 percent by weight aromatic polyepoxide having a functionality greater than 2.5, based on the total combined weight of polyfunctional acrylate, alicyclic polyepoxide, and aromatic polyepoxide having an average epoxy functionality of at least 2.5.

14. The coated abrasive article of claim 2, wherein the components comprise from about 14 to about 54 percent by weight aromatic polyepoxide having a functionality greater than 2.5, based on the total combined weight of polyfunctional acrylate, alicyclic polyepoxide, and aromatic polyepoxide having an average epoxy functionality of at least 2.5.

15. The coated abrasive article of claim 2, wherein the components comprise from about 17 to about 23 percent by weight aromatic polyepoxide having a functionality greater than 2.5, based on the total combined weight of polyfunctional acrylate, alicyclic polyepoxide, and aromatic polyepoxide having an average epoxy functionality of at least 2.5.

16. The coated abrasive article of claim 2, wherein said polyfunctional acrylate has an average acrylate functionality of at least 2.5.

17. The coated abrasive article of claim 2, wherein said aromatic polyepoxide has an average epoxy functionality of at least 3.5.

18. The coated abrasive article of claim 17, wherein the backing comprises one of a polymeric substrate having hooking stems projecting therefrom, or a loop fabric.

19. The coated abrasive article of claim 2, wherein the article is in the form of a disc.

20. The coated abrasive article of claim 2, wherein the article is in the form of a roll.

21. The coated abrasive article of claim 2, wherein the article is in the form of an endless belt.

22. A coated abrasive article comprising:

a backing having a major surface;

an abrasive layer secured to at least a portion of the major surface, the abrasive layer comprising a slurry layer comprising a binder and abrasive particles, wherein the binder comprises a reaction product of components comprising polyfunctional acrylate, aromatic polyepoxide having an epoxy functionality of at least 2.5, and from about 1 to about 27 percent by weight alicyclic polyepoxide, based on the total combined weight of polyfunctional acrylate, alicyclic polyepoxide, and aromatic polyepoxide having an average epoxy functionality of at least 2.5.

23. The coated abrasive article of claim 22, wherein the components further comprise at least one photoinitiator.

24. The coated abrasive article of claim 22, wherein the components further comprise at least one photocatalyst.

25. The coated abrasive article of claim 22, wherein the components further comprise at least one photoinitiator and at least one photocatalyst.

26. The coated abrasive article of claim 22, wherein the coated abrasive article further comprises at least one of a backsize layer, supersize layer, presize layer, or saturant.

27. The coated abrasive article of claim 22, wherein the backing is polypropylene.

28. The coated abrasive article of claim 22, wherein the components comprise from about 5 to about 90 percent by weight polyfunctional acrylate, based on the total combined weight of polyfunctional acrylate, alicyclic polyepoxide, and aromatic polyepoxide having an average epoxy functionality of at least 2.5.

29. The coated abrasive article of claim 22, wherein the components comprise from about 20 to about 85 percent by weight polyfunctional acrylate, based on the total combined weight of polyfunctional acrylate, alicyclic polyepoxide, and aromatic polyepoxide having an average epoxy functionality of at least 2.5.

30. The coated abrasive article of claim 22, wherein the components comprise from about 60 to about 80 percent by weight polyfunctional acrylate, based on the total combined weight of polyfunctional acrylate, alicyclic polyepoxide, and aromatic polyepoxide having an average epoxy functionality of at least 2.5.

31. The coated abrasive article of claim 22, wherein the components comprise from about 6 to about 13 percent by weight alicyclic polyepoxide, based on the total combined weight of polyfunctional acrylate, alicyclic polyepoxide, and aromatic polyepoxide having an average epoxy functionality of at least 2.5.

32. The coated abrasive article of claim 22, wherein the components comprise from about 8 to about 12 percent by weight alicyclic polyepoxide, based on the total combined weight of polyfunctional acrylate, alicyclic polyepoxide, and aromatic polyepoxide having an average epoxy functionality of at least 2.5.

33. The coated abrasive article of the claim 22, wherein the components comprise from about 6 to about 75 percent by weight aromatic polyepoxide having a functionality greater than 2.5, based on the total combined weight of polyfunctional acrylate, alicyclic polyepoxide, and aromatic polyepoxide having an average epoxy functionality of at least 2.5.

34. The coated abrasive article of claim 22, wherein the components comprise from about 14 to about 54 percent by weight aromatic polyepoxide having a functionality greater than 2.5, based on the total combined weight of polyfunctional acrylate, alicyclic polyepoxide, and aromatic polyepoxide having an average epoxy functionality of at least 2.5.

35. The coated abrasive article of claim 22, wherein the components comprise from about 17 to about 23 percent by weight aromatic polyepoxide having a functionality greater than 2.5, based on the total combined weight of polyfunctional acrylate, alicyclic polyepoxide, and aromatic polyepoxide having an average epoxy functionality of at least 2.5.

36. The coated abrasive article of claim 22, wherein said polyfunctional acrylate has an average acrylate functionality of at least 2.5.

37. The coated abrasive article of claim 22, wherein said aromatic polyepoxide has an average epoxy functionality of at least 3.5.

38. The coated abrasive article of claim 22, wherein the article is in the form of a disc.

39. The coated abrasive article of claim 22, wherein the backing comprises one of a polymeric substrate having hooking stems projecting therefrom, or a loop fabric.

40. The coated abrasive article of claim 22, wherein tile article is in the form of a roll.

41. The coated abrasive article of claim 22, wherein the article is in the form of an endless belt.

42. A method for making a coated abrasive article comprising:

providing a backing having a major surface;

applying a make layer comprising a first binder precursor onto at least a portion of the major surface of the backing;

at least partially embedding a plurality of abrasive particles into the make layer;

curing the first binder precursor;

applying a size layer comprising a second binder precursor onto at least a portion of the make layer and plurality of abrasive particles; and curing the second binder precursor to provide a coated abrasive article, wherein at least one of the first or second binder precursors comprises polyfunctional acrylate, aromatic polyepoxide having an average epoxy functionality of at least 2.5, and from about 1 to about 27 percent by weight alicyclic polyepoxide, based on the total combined weight of polyfunctional acrylate, alicyclic polyepoxide, and aromatic polyepoxide having an average epoxy functionality of at least 2.5, and wherein at least one of the first or second binder precursors is cured by exposure to actinic radiation.

43. A method for making a coated abrasive article comprising:

providing a backing having a major surface;

applying a slurry comprising a binder precursor and abrasive particles onto at least a portion of the major surface of the backing, the binder precursor comprising at least one polyfunctional acrylate, at least one aromatic polyepoxide having an epoxy functionality of at least 2.5, and from about 1 to about 27 percent by weight of at least one alicyclic polyepoxide, based on the total combined weight of polyfunctional acrylate, alicyclic polyepoxide, and aromatic polyepoxide having an average epoxy functionality of at least 2.5; and curing the binder precursor by exposure to actinic radiation to provide a coated abrasive article.

44. A method of abrading a workpiece comprising:

providing a coated abrasive article comprising:

a backing having a major surface;

an abrasive layer secured to at least a portion of the major surface, the abrasive layer comprising a make layer comprising a first binder and abrasive particles; and a size layer comprising a second binder at least partially covering the abrasive layer, wherein at least one of the first or second binders comprise a reaction product of components comprising at least one polyfunctional acrylate, at least one aromatic polyepoxide having an average epoxy functionality of at least 2.5, and from about 1 to about 27 percent by weight of at least one alicyclic polyepoxide, based on the total combined weight of polyfunctional acrylate, alicyclic polyepoxide, and aromatic polyepoxide having an average epoxy functionality of at least 2.5; and frictionally contacting at least a portion of the abrasive layer with at least a portion of the surface of the workpiece; and moving at least one of the coated abrasive article or the workpiece relative to the other to abrade at least a portion of the surface.

45. A method of abrading a workpiece comprising:

providing a coated abrasive article comprising:

a backing having a major surface;

an abrasive layer secured to at least a portion of the major surface, the abrasive layer comprising a slurry layer comprising a binder and abrasive particles, wherein the binder comprises a reaction product of components comprising at least one polyfunctional acrylate, at least one aromatic polyepoxide having an average epoxy functionality of at least 2.5, and from about 1 to about 27 percent by weight of at least one alicyclic polyepoxide, based on the total combined weight of polyfunctional acrylate, alicyclic polyepoxide, and aromatic polyepoxide having an average epoxy functionality of at least 2.5; and frictionally contacting at least a portion of the abrasive layer with at least a portion of the surface of the workpiece; and moving at least one of the coated abrasive article or the workpiece relative to the other to abrade at least a portion of the surface.

* * * * *

UNITED STATES PATENT AND TRADEMARK OFFICE

CERTIFICATE OF CORRECTION

PATENT NO. : 6,758,734 B2
DATED : July 6, 2004
INVENTOR(S) : Braunschweig, Ehrich J.

It is certified that error appears in the above-identified patent and that said Letters Patent is hereby corrected as shown below:

Column 5,
Line 48, delete “yams” and insert therefor -- yarns --.
Line 51, after “thereof” insert -- , --.

Column 12,
Line 47, delete “U-phenylbenzoin” and insert -- α-phenylbenzoin --.

Column 20,
Lines 41 and 46, delete “P12” and insert therefor -- PI2 --.

Column 23,
Line 57, delete “P13” and insert therefor -- P13 --.

Column 24,
Line 65, after “25-26,” insert -- the --.

Column 26,
Line 5, delete “art” and insert therefor -- an --.

Column 27,
Line 50, after “of” delete “the”

Column 28,
Line 12, delete “tile” and insert therefor -- the --.
Line 46, after “acrylate,” delete “at” .

UNITED STATES PATENT AND TRADEMARK OFFICE

CERTIFICATE OF CORRECTION

PATENT NO. : 6,758,734 B2 
DATED : July 6, 2004
INVENTOR(S) : Braunschweig, Ehrich J.

It is certified that error appears in the above-identified patent and that said Letters Patent is hereby corrected as shown below:

Column 30,
Line 3, after "acrylate," delete "at".

Signed and Sealed this

Fourteenth Day of September, 2004

JON W. DUDAS
*Director of the United States Patent and Trademark Office*